US005582350A

United States Patent [19]

Kosmyna et al.

[11] Patent Number: 5,582,350

[45] Date of Patent: Dec. 10, 1996

[54] HAND HELD PAINT SPRAY GUN WITH TOP MOUNTED PAINT CUP

[75] Inventors: Michael J. Kosmyna, Toledo, Ohio; Mark E. Charpie, Lambertville, Mich.; Ralph A. Wisniewski, Toledo, Ohio

[73] Assignee: Ransburg Corporation, Indianapolis, Ind.

[21] Appl. No.: 551,167

[22] Filed: Oct. 31, 1995

Related U.S. Application Data

[63] Continuation of Ser. No. 229,651, Apr. 19, 1994, abandoned.

[51] Int. Cl.[6] ..... B05B 7/30

[52] U.S. Cl. ..... 239/345; 239/346; 239/DIG. 14

[58] Field of Search ..... 239/345, 346, 239/379, 340, 318, 311, DIG. 14, 289; 222/105, 83.5; 220/293, 300; 215/321

[56] References Cited

U.S. PATENT DOCUMENTS

| | | | |
|---|---|---|---|
| 1,737,299 | 11/1929 | Cuel | 239/119 |
| 1,748,440 | 2/1930 | Burdick | 239/345 |
| 1,929,348 | 10/1933 | Cathcart | 239/119 X |
| 2,196,800 | 4/1940 | Krautzberger | 239/345 X |
| 2,333,243 | 11/1943 | Glab | 220/293 X |
| 2,676,844 | 4/1954 | Paasche | 239/119 |
| 2,805,795 | 9/1957 | Barnes | 220/330 X |
| 2,961,335 | 11/1960 | Shepard | 239/345 X |
| 4,140,279 | 2/1979 | Hawkins | 239/345 X |
| 4,444,332 | 4/1984 | Widen et al. | 215/321 X |
| 4,746,063 | 5/1988 | Roberts | 239/119 X |
| 4,978,072 | 12/1990 | Kurowski | 239/346 |
| 5,069,389 | 12/1991 | Bitsakos | 239/345 X |
| 5,115,943 | 5/1992 | Coleman | 222/105 X |
| 5,143,294 | 9/1992 | Lintvedt | 222/105 X |
| 5,307,994 | 5/1994 | Hieronymus | 239/340 |

FOREIGN PATENT DOCUMENTS

| | | | |
|---|---|---|---|
| 43878 | 4/1910 | Austria | 239/345 |
| 371768 | 3/1907 | France | 239/345 |
| 840818 | 7/1949 | Germany | 239/345 |
| 510296 | 5/1956 | Germany | 239/345 |
| 253789 | 7/1927 | Italy | 239/379 |
| 1512675 | 10/1989 | U.S.S.R. | 239/345 |
| 130047 | 7/1919 | United Kingdom | 239/345 |
| 23826 | 7/1927 | United Kingdom | 239/345 |
| 498770 | 1/1939 | United Kingdom | 239/379 |
| 682779 | 11/1952 | United Kingdom | 220/293 |

*Primary Examiner*—Lesley D. Morris
*Attorney, Agent, or Firm*—MacMillan, Sobanski & Todd

[57] ABSTRACT

A hand held paint spray gun having a top mounted paint cup which extends from the rear of a gun body at an angle of 30°±10° to an axis about which the atomized paint is discharged. A retainer ring secures a lid on the cup. The lid seals to both the inside and the outside of the cup. The double seals reduce the risk of paint leakage. Preferably, the gun operates with suction paint feed which is augmented by gravity feed when paint in the cup is located above a nozzle assembly on the gun. To facilitate cleaning and to allow the gun to spray in an upward direction, the paint may be sealed in a collapsible closed bag located in the cup. With the closed bag and the suction feed, the gun will operate when aimed in all directions. The gun is easily cleaned by forcing solvent from the nozzle assembly back into the bag and disposing of the bag containing any remaining paint and the used solvent.

23 Claims, 7 Drawing Sheets

HAND HELD PAINT SPRAY GUN WITH TOP MOUNTED PAINT CUP

This is a continuation of application Ser. No. 08/229,651 filed Apr. 19, 1994, now abandoned.

TECHNICAL FIELD

The invention relates to fluid spraying and more particularly to an improved hand held paint spray gun having a top mounted paint cup for supplying paint to a nozzle on the spray gun.

BACKGROUND ART

Paint is generally delivered to a hand held paint spray gun from one of three sources. For large commercial applications which do not require frequent color change, the paint may be fed through a hose connected to a remote pressurized paint source. For smaller commercial and non commercial applications, the paint is generally placed in a cup attached to the gun. Most commonly, the paint cup is suspended below a front end of a body on the gun. The paint is often fed to a nozzle by suction or aspiration induced by atomization air flow through the gun. For viscous paints and for guns operating on low air pressures, the cup may be pressurized to increase the paint application rate. Finally, a paint cup is sometimes mounted above the gun body for gravity paint feed to the gun nozzle. Whether the cup is suspended below or mounted above the gun body, the cup has traditionally been mounted towards the front end of the body near the nozzle, since the paint must be delivered to the nozzle. In either case, the weight of the paint cup on the front end of the gun adversely affects the balance of the gun and may increase operator fatigue during extended use. Further, when the paint cup is secured above the front end of the gun body, it can adversely affect operator visibility during use.

Typically, when a paint cup has been mounted on the top of a hand held spray gun, it extends upwardly at an angle of at least 45° relative to the spray axis about which paint is discharged. Often the angle is greater to facilitate filling the paint cup while the gun is supported on a stand. When paint is delivered from a cup by either suction or gravity feed, it is necessary to have a vent opening in the cup to allow air to enter the cup as paint is consumed. For gravity feed guns, the vent opening normally is located in the center of the cup lid as a compromise for keeping the vent opening as high as possible when spraying both vertical surfaces and the top of horizontal surfaces. A gravity feed spray gun is not suitable for spraying in an upward direction at the bottom of a horizontal surface, since the paint will not flow by gravity to the gun nozzle and paint can drip from the vent opening in the cup lid. Further, the paint feed tube will not be submerged in the paint in the cup.

When the paint cup is mounted on a hand held gun, paint leakage can be a problem when painting the top of a horizontal surface. In hand held spray guns having conventional paint cups, at least a portion of the cup lid may become submerged under the paint when coating top surfaces, such as a vehicle roof or hood, with a full paint cup. Paint can leak either from a defective lid seal or from the lid vent and drip on the workpiece during spraying horizontal surfaces where the gun is held above the surface. Surveys indicate that the most common painting problems are leaks from the cup lid seal and vent when painting top surfaces. Paint drips on the workpiece can necessitate costly repaints. In order to reduce dripping problems, prior art guns typically seal the paint cup lid either with a separate resilient gasket or with a thin resilient sealing rib. The gasket can leak because it becomes harder as paint is absorbed during use or it becomes worn from use. A thin plastic sealing rib is easily damaged. Further, both conventional cup seals will leak if not properly cleaned.

Top mounted paint cups also can present additional problems for the spray gun operator. In the prior art guns, the cup is screwed onto the top of the spray gun body. The paint cup lid is secured to the cup either by screwing the lid to the cup or by screwing a lid retainer ring to the cup. If any paint reaches the threads, the lid or the lid retainer ring may be difficult to remove. The extra force required to remove the lid may be sufficient to cause the paint cup to unscrew from the spray gun. Also, cleaning the prior art spray guns has been time consuming and expensive. For commercial operations, an expensive gun cleaner is generally required to meet environmental regulations. As much as 8 fluid ounces (0.24 liter), or more, of solvent has been required to clean a typical prior art gun and paint cup and lid. Any reduction in the amount of solvent used can reduce cleanup and solvent disposal costs and reduce potential environmental problems.

DISCLOSURE OF INVENTION

The invention is directed to a hand held paint spray gun of the type which has a paint cup mounted above the gun body. The paint cup is designed either for gravity paint feed or, preferably, for suction feed in combination with gravity feed. The paint cup is secured by a bracket to adjacent a rear end of the gun body. Preferably, the paint cup angles upwardly at an angle of about 30°±5° to the spray discharge axis. With the cup mounted at this angle at the rear of the gun, operator visibility is significantly improved and the weight balance of the gun is improved.

Paint flows from adjacent a lower front comer of the cup through a polytetrafluoroethylene (Teflon) tube to the gun nozzle. The cup is closed by a lid having an improved vent opening located adjacent an uppermost portion of the lid and an improved lid to cup seal. At an open end of the cup, both the interior and the exterior annular surface edges are finished smooth and each is tapered at an angle of 10°±5° relative to an axis of the cup. Spaced bayonets are formed on a an integral rim on the cup adjacent the tapered edges at the open end. A lid is provided with a tapered groove which engages both the tapered interior edge and the tapered exterior edge of the cup end. A retainer ring fits over the lid and is retained on the lid by resilient tabs. The retainer ring is easily removed from the top for cleaning without the need for tools. The retainer ring fits over the open top of the cup and is rotated to engage the bayonets for releasably securing the lid to the cup. The tapered cup edges cooperate with the tapered lid groove to form double fluid tight seals between the lid and the cup. The combination of the paint cup mounting angle, the location of the vent and the improved lid seal greatly reduces the possibility of paint leakage when spraying either vertical or horizontal surfaces.

Preferably, a disposable collapsible bag is used to line the paint cup. A bushing forms a fluid tight connection between a drain opening in the bag and a fluid outlet from the paint cup. A tool may be used to pierce the opening in the bag and insert the bushing into the formed opening and for inserting the bushing into a paint outlet opening in the bottom of the paint cup. The bag has an open end adjacent the cup lid which can be closed with an integral fluid tight zipper after the bag is filled with paint. When a bag is used, the paint cup is never contaminated with paint and accordingly does not need cleaning after use. If the gun operates with suction paint feed and all trapped air is purged from the closed bag, the gun will operate to spray in an upward direction as well as in the conventional horizontal and downward directions. After spraying is completed, the atomization air is turned off to interrupt suction on the paint feed tube. The gun trigger is then squeezed and a squeeze bottle or a syringe is used to force solvent to flow from the spray gun nozzle back through the gun and into the bag. The gun may be cleaned with as little as 2 oz. (0.06 liter) of solvent. Thus, paint is purged from the gun and the paint feed tube and collected in the closed bag. The bag containing any remaining unused paint and the used solvent is removed from the cup and is easily disposed of. Back flushing paint and solvent into the closed bag appears to conform to existing environmental regulations for enclosed gun cleaners, since the solvent and paint are collected in the closed bag and not dispersed into the atmosphere. Thus, the need for an expensive gun cleaner is eliminated.

Accordingly, it is an object of the invention to provide an improved hand held paint spray gun of the type having a top mounted paint cup.

Other objects and advantages of the invention will become apparent from the following detailed description of the invention and the accompanying drawings.

MODE FOR CARRYING OUT THE INVENTION

Figure 1:
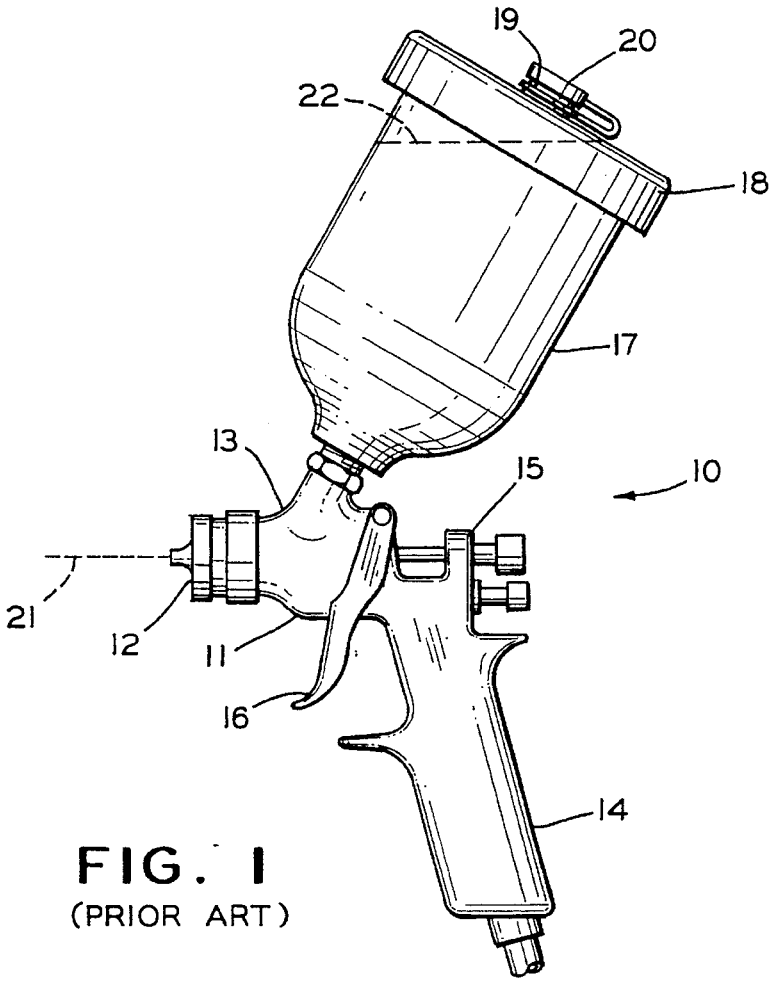
FIG. 1 (PRIOR ART)
FIG. 1 is a side elevational view of a typical prior art gravity feed hand held paint spray gun oriented for spraying about a horizontal axis for painting vertical surfaces.
Figure 2:
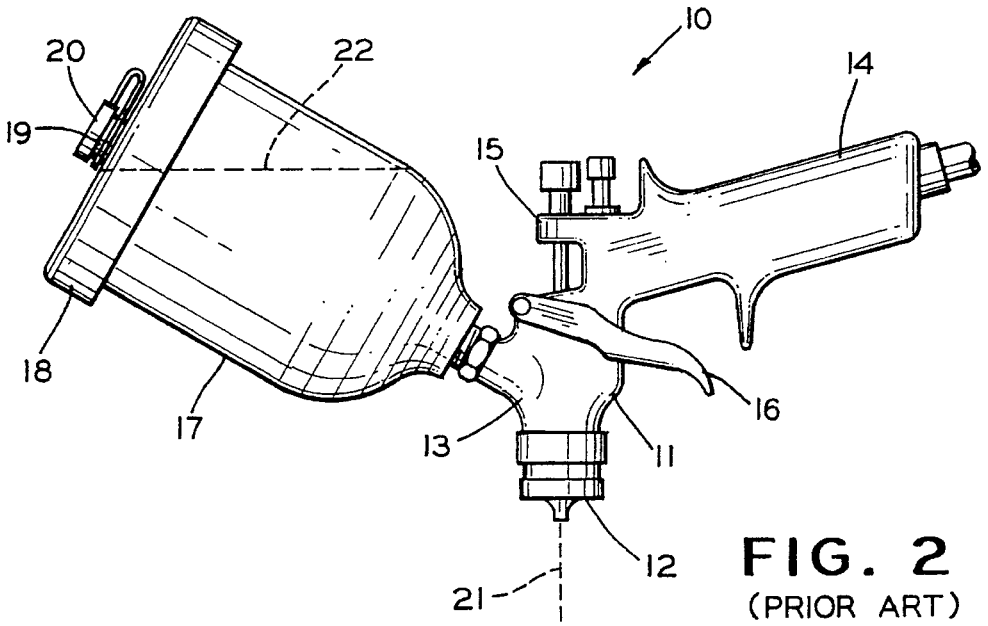
FIG. 2 (PRIOR ART)
FIG. 2 is a side elevational view of the spray gun of FIG. 1 oriented for painting the top of horizontal surfaces.

Referring first to FIGS. 1 and 2 of the drawings, a prior art hand held paint spray gun 10 is illustrated. The spray gun 10 generally includes a body 11, a nozzle assembly 12 secured to a front end 13 of the body 11, and a handle 14 depending from a rear end 15 of the body 11. A trigger 16 is pivotally secured to the body 11 for manually operating the gun 10. A top mounted, gravity feed paint cup 17 is secured to the body 11 near the front end 13 for delivering paint to the nozzle assembly 12. The paint cup 17 is closed by a lid 18 which is screwed onto the cup 17. A vent 19 is located in the center of the lid 18. The vent is closed by a removable vented cap 20 to reduce the likelihood of dripping while permitting easy cleaning of the vent 19.

While operating, the spray gun 10 discharges atomized paint about a spray axis 21. In the typical prior art gravity feed spray gun 10, the paint cup 17 is screwed into the spray gun body 11 to extend at an angle of at least 45° to the spray axis 21. Prior to use, the gun 10 is supported on a stand (not shown) which holds the gun 10 with the paint cup 17 vertical. The paint cup 17 is filled and the lid 18 is secured to the cup 17. When the cup 17 is filled to the maximum and the gun 10 is positioned as in FIG. 1 with the spray axis 21 horizontal for painting side surfaces, the paint will have an upper surface 22 which is located slightly below the vent 19. When the gun is rotated 90° so that the axis 22 is vertical for painting top surfaces as shown in FIG. 2, the paint surface 22 in the cup 17 also will be slightly below the vent 19. Preferably, the gun 10 is oriented during use so that the axis 21 is perpendicular to the surface being painted. It will be seen in FIG. 1 that if the gun 10 is tipped slightly for spraying in an upward direction, the vent 19 will become submerged under the paint surface 22. Similarly, if the gun 10 in FIG. 2 is tipped past the vertical, the vent 19 also will become submerged under the paint surface 22. In either case, the paint will eventually leak from the vent 19. The cap 20 forms a small chamber (not shown) with the vent 19 to delay the dripping. If the gun 10 is returned to a position wherein the vent 19 is no longer submerged prior to dripping from the vented cap 20, the paint will flow from the chamber back into the cup 17. It will be seen in FIGS. 1 and 2 that a substantial portion of the lid 18 ma, be located below the paint surface 22 when the cup 17 is full. If the seal between the cup 17 and the lid 18 fails, paint will leak between the lid 18 and the cup 17 and drip. When the gun is in the FIG. 2 position for spraying top surfaces, the leaking paint can drip on the surface being painted, resulting in costly repairs.

Figure 3:
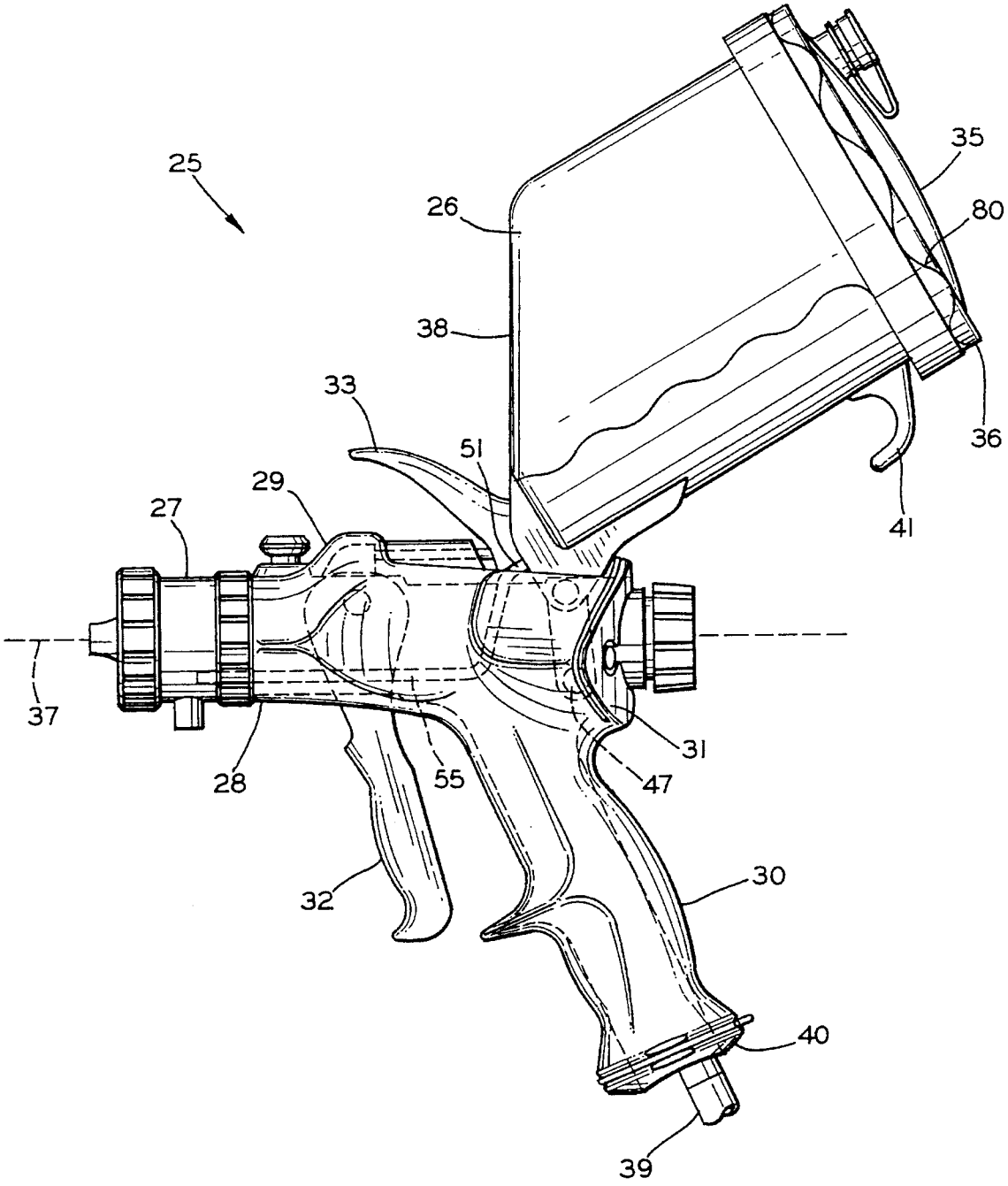
FIG. 3 is a side elevational view of a hand held paint spray gun with a top mounted paint cup according to the invention oriented for spraying about a horizontal axis for painting vertical surfaces.
Figure 4:
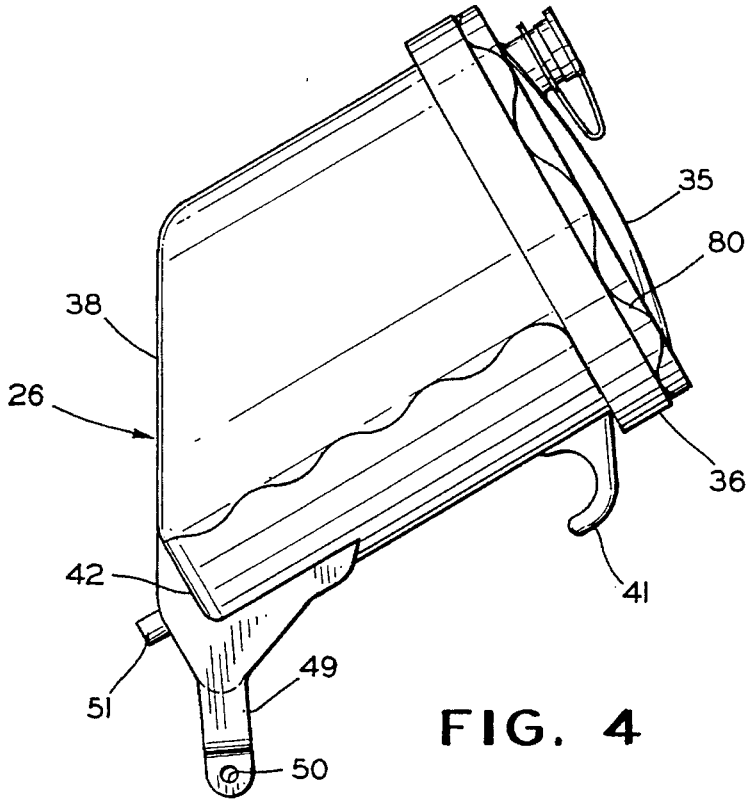
FIG. 4 is a side elevational view of the paint cup and lid from the spray gun of FIG. 3.

Turning to FIG. 3, a hand held paint spray gun 25 having a top mount paint cup 26 is illustrated according to the invention. The spray gun 25 has a nozzle assembly 27 secured to a front end 28 of a body 29 and a handle 30 depending from adjacent a rear end 31 of the body 29. A main trigger 32 is pivotally secured to the body 29 for operating the spray gun 25 while the gun 25 is held by the handle 30. Optionally, the gun 25 may have an auxiliary trigger 33 pivotally mounted on the body 29 to extend above the body 29. When spraying top surfaces of a workpiece (not shown), the operator may grasp the gun body 29 and operate the gun with the auxiliary trigger 33.

Details of the paint cup 26 are shown in FIGS. 3–6. The cup 26 may be formed from a strong light weight solvent resistant plastic material. Preferably, the cup is formed from acetal manufactured and sold by Dupont under the trademark Delryn, which does not absorb paint like typical nylon paint cups and therefore is easier to clean. The paint cup 26 has an open end 34 (FIG. 5) which during use of the spray gun 25 is closed by a lid 35. The lid 35 is releasably secured to the cup 26 by a retainer ring 36, which is described in greater detail below. The nozzle assembly 27 on the spray gun 25 atomizes and discharges paint about a spray axis 37.

The paint cup 26 is generally cylindrical and extends above and to the rear of the gun body 29 at an angle of 30°±5° and preferably at an angle of 30° to the spray axis 37. The cup 26 has an oblique front 38 which extends substantially perpendicular to the spray axis 37. The cup location reduces the forward weight on the gun to improve maneuverability and operator visibility over prior art guns having a top mounted cup attached to the front of the gun body. Further, the weight of the cup 26 opposes the weight of an air hose 39 secured to a lower end 40 of the gun handle 30 to improve the balance of the gun 25. To facilitate filling the cup 26 and supporting the gun 25 when not in use, a hook 41 is formed at a lower rear portion of the cup 26. When the gun 25 is hung by the hook 41, the cup 26 will be substantially vertically oriented so that the lid 35 and the open cup end 34 are not submerged under the paint.

Figure 6:
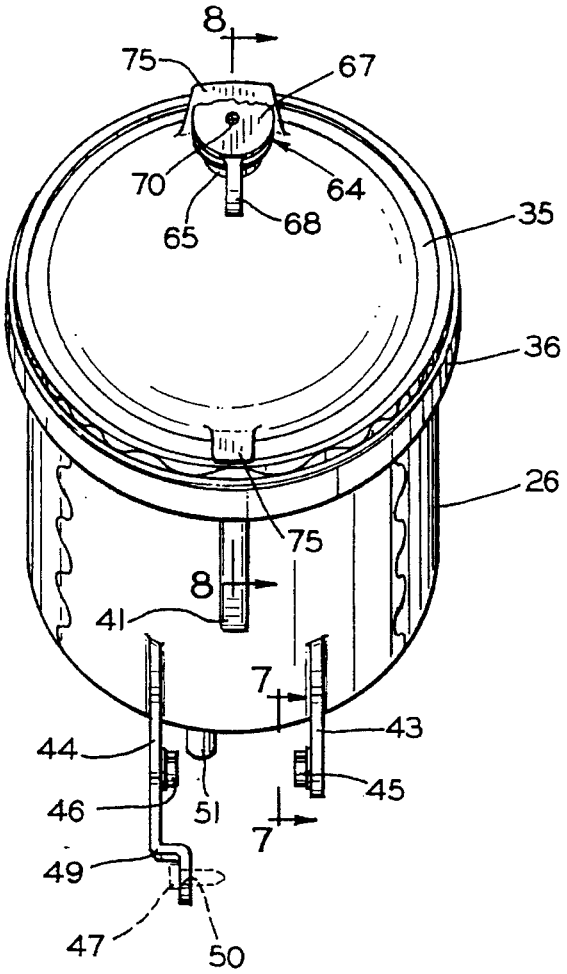
FIG. 6 is a rear elevational view of the paint cup of FIG. 4.
Figure 7:
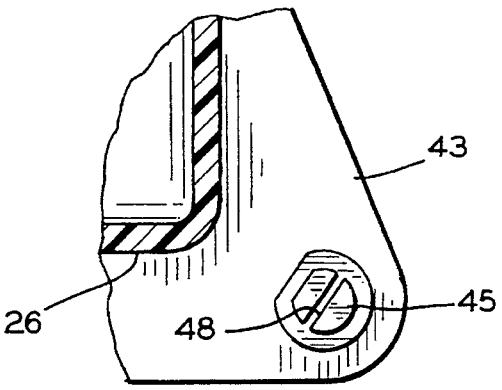
FIG. 7 is a fragmentary cross sectional view as taken along line 7—7 of FIG. 6.

A lower front corner 42 of the paint cup 26 is secured to the spray gun body 29 by a pair of spaced brackets 43 and 44. As shown in FIGS. 6 and 7, a pin 45 projects from the bracket 43 towards the bracket 44 and a pin 46 projects from the bracket 44 towards the bracket 43. The pins 45 and 46 are coaxially aligned. As shown in FIG. 7, the pin 45 may have a center split 48. The pin 46 has a similar shape. The bracket 44 has an extended end 49. The brackets 43 and 44 straddle the rear end 31 of the spray gun body. The pins 45 and 46 engage openings (not shown) in the gun body 29 formed in the ends of pivots (not shown) for the auxiliary trigger 33. A screw or bolt 47 is passed through a hole 50 in the extended bracket end 49 for securing the cup 26 to the bun body 29. Construction details of the spray gun body and of the upper trigger pivots are shown, for example, in commonly owned allowed U.S. patent application Ser. No. 08/048,277, the disclosure of which is incorporated herein. Between the two pins 45 and 46 and the screw in the bracket hole 50, a three point connection is made between the paint cup 26 and the gun body 29 to rigidly secure the paint cup 26 to the gun body 29. The split 48 in the pins 45 and 46 permits the resilient pins to be slightly compressed in the complementary gun body holes for a tight fit.

Figure 5:
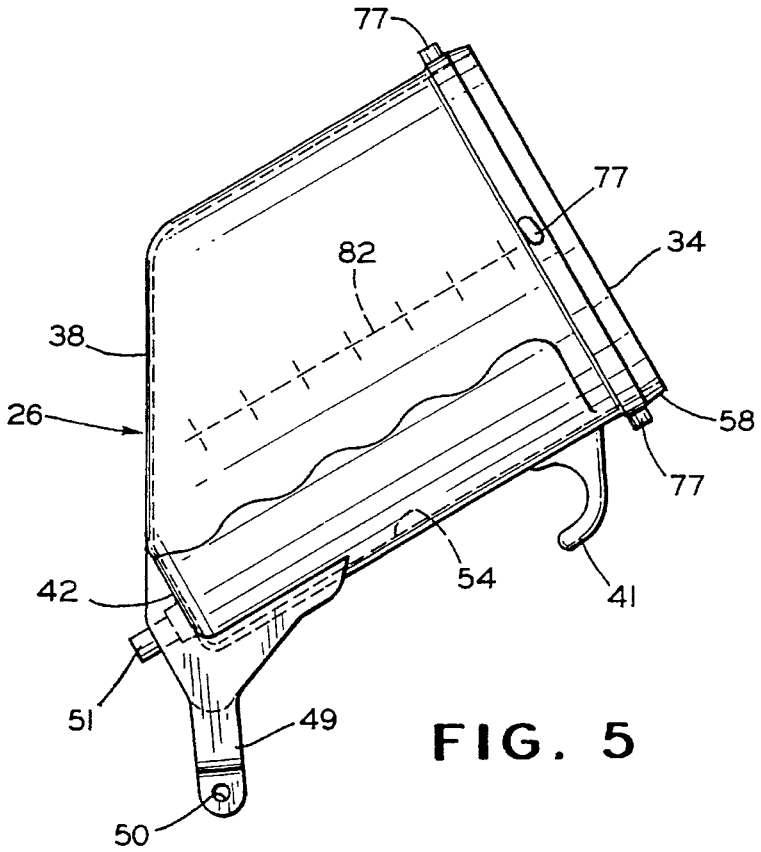
FIG. 5 is a side elevational view of the paint cup of FIG. 4 with the lid removed.
Figure 11:
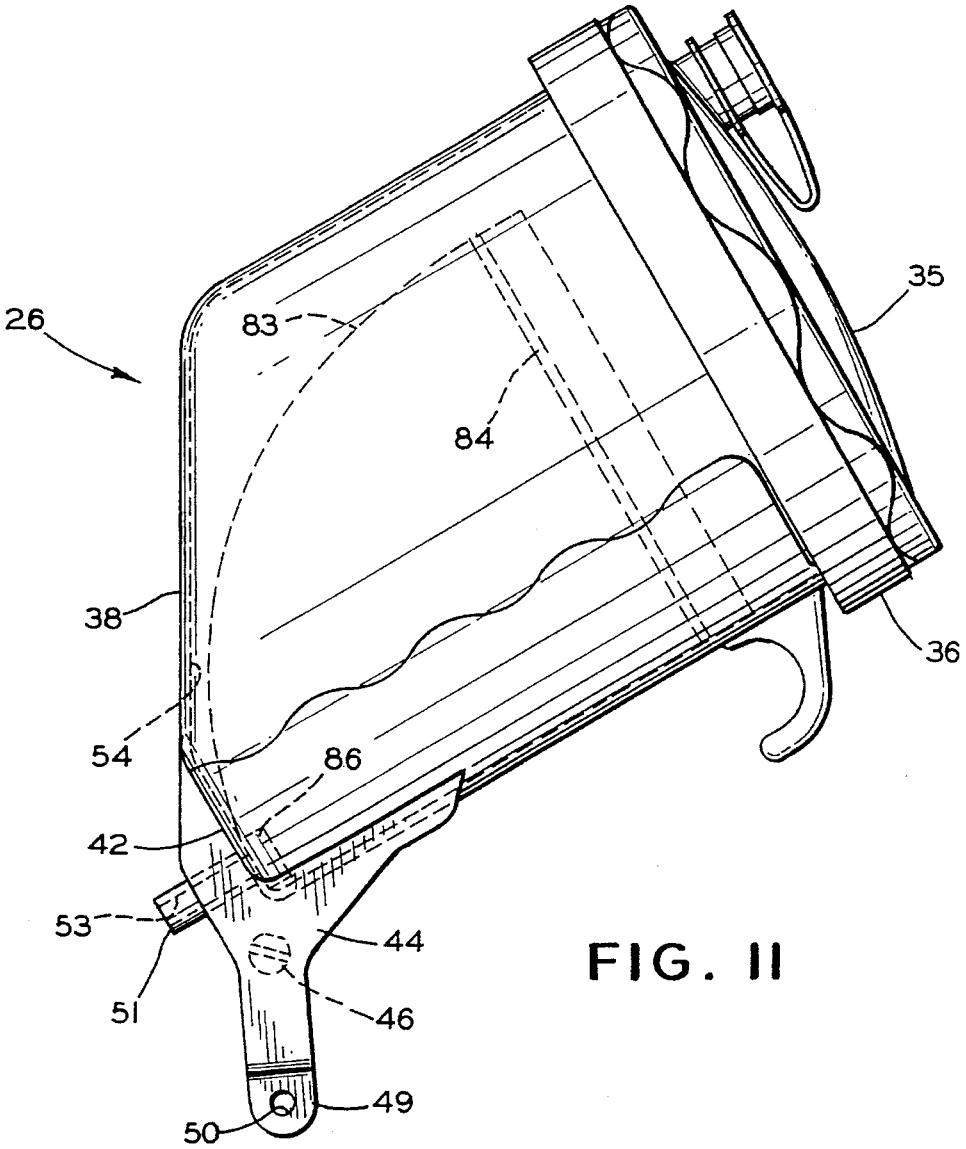
FIG. 11 is an enlarged view of the paint cup of FIG. 4 and showing in dashed lines a partially filled liner bag inside of the paint cup.

As best shown in FIGS. 3, 5 and 11, a nipple 51 extends from a lower front corner 42 of the paint cup 26. The nipple 51 has a central opening 53 which communicates with an interior 54 of the paint cup 26. The nipple 51 is connected through a tube 55 (FIG. 3) to deliver paint from the cup 26 to the gun nozzle assembly 27. Preferably, the tube 55 is made of polytetrafluoroethylene (Teflon) which is highly resistant to paint solvents and is easily cleaned because of its low adhesion for paint. Although the paint may be delivered from the cup 26 to the nozzle assembly 27 strictly through gravity feed, it is preferable that the nozzle assembly create a suction to draw paint through the tube 55. The suction feed will be further enhanced by gravity, so long as the gun 25 is oriented with paint in the cup 26 above the nozzle assembly 27.

Figure 8:
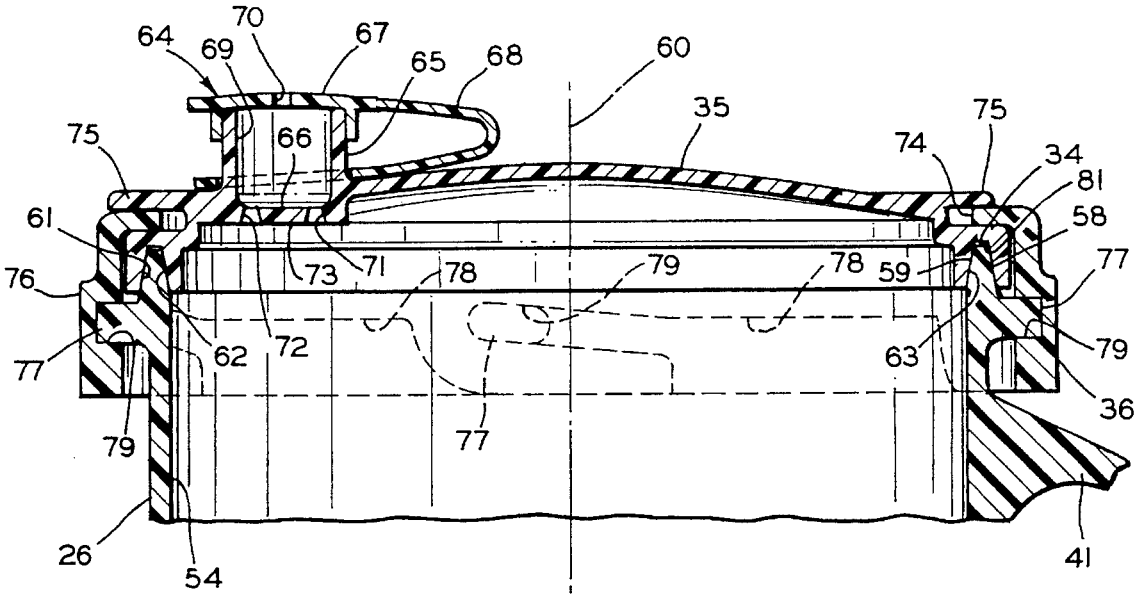
FIG. 8 is a fragmentary cross sectional view as taken along line 8—8 of FIG. 6.

Details of the open cup end 34, the lid 35 and the lid retainer ring 36 are shown in FIG. 8. The cup 26 has a tapered exterior annular surface 58 and a tapered interior annular surface 59 at the open end 34. The surfaces 58 and 59 are preferably at an angle of 10°±5° relative to a longitudinal axis 60 through the cup 26. The surfaces 58 and 59 seal, respectively, against complementary tapered annular surfaces 61 and 62 formed in a groove 63 in the lid 35. The two surfaces 58 and 59 form a tongue at the open cup end 34 which engage the lid groove 63 in a manner such that each surface 58 and 59 forms a separate seal. With double seals, there is less likelihood of leakage between the cup 26 and the lid 35, since both seals would have to fail. If paint is not properly cleaned off of the cup surfaces 58 and 59 or from the lid groove 63, the tongue and groove tend to be self cleaning as they are rotated or pushed together. Further, the tongue and groove are larger than the prior art sealing ribs, so they are easier to clean and resists damage better.

An improved vent 64 is formed in the lid 35, as best illustrated in the sectional view of FIG. 8. The vent 64 is located off center on the lid 35 towards the uppermost portion of the cup 26 when the cup 26 is oriented as in FIGS. 3, 4.and 6. The vent generally consists of a tubular section 65 integral with the lid 35 and having a bottom 66. The tubular section 65 is closed by a removable cap 67. The cap 67 is pressed onto the tubular section 65 and when removed from the tubular section 65 is retained by a tether 68. The tubular section 65, the bottom 66 and the cap 67 cooperate to form a chamber 69. A small central vent opening 70 is formed through the cap. The cap 67 and the tubular section 65 are similar to those used in prior art paint cup vents. However, the prior art vents had only a single central vent opening through the bottom 66. According to the invention, two vent openings 71 and 72 are formed in the bottom 66. The vent opening 71 is located to be at the bottom of the chamber 69 when the spray gun 25 is oriented with the spray axis 37 horizontal and the vent opening 72 is located to be at the bottom of the chamber 69 when the spray gun 25 is oriented with the spray axis 37 vertical. Thus, the two vent openings allow paint to drain from the chamber 69 over a greater range of positions of the spray gun 25. At least the portion of the openings 71 and 72 at an inner side 73 of the lid 35 are chamfered. The chamfers prevent to paint from "skinning over" and clogging the openings 71 and 72. Depending on the thickness of the bottom 66, the vent openings 71 and 72 may be straight holes which are chamfered only at the inner lid side 73, or they may be chamfered over their entire length, as shown.

FIG. 8 shows details of the retainer ring 36 and its operation for securing the cap 35 to the paint cup 26. The retainer ring 36 has an upper lip 74 having a smaller inner diameter than the diameter of the lid 35. A pair of diametrically opposing resilient tabs 75 on the lid 35 engage the lip 74 for retaining the ring 36 on the lid 35. The tabs 75 keep the lid 35 and the retainer ring 36 together as one piece during use, while permitting easy separation of the retainer ring 36 from the lid 35 for cleaning. The ring 36 has a generally tubular side 76 having an interior sized to fit over the open cup end 34. Four bayonets 77 are spaced around and project radially from the cup 26 immediately below the tapered exterior surface 58. The interior of the retainer ring 36 is formed with recesses 78 which receive the bayonets 77 when the ring 36 is positioned over the cup end 34. After the retainer ring 36 is positioned on the cup end 34, it is rotated and the bayonets 77 move into angled slots 79. The bayonets 77 and the slots 79 cooperate like short screw threads for securing the retainer ring 36 onto the cup 35 and for forcing the tapered cup surfaces 58 and 59 to seal against the tapered lid groove surfaces 61 and 62, respectively. When the cup end 34 is positioned in the lid groove 63, the cup end 34 preferably is spaced from a bottom 81 of the lid groove 63. Having a space between the cup end 34 and the lid groove bottom 81 assures that the tapered cup surfaces 58 and 59 will contact and seal against the tapered lid groove surfaces 61 and 62, respectively. Preferably, the bayonets 77 have an elongated cross section and are disposed at the same angle as the slots 79 for increased strength. The retainer ring 36 may have a textured or rippled exterior surface 80 to facilitate grasping when securing the retainer ring.36 to or removing the retainer ring 36 from the cup 26.

Figure 9:
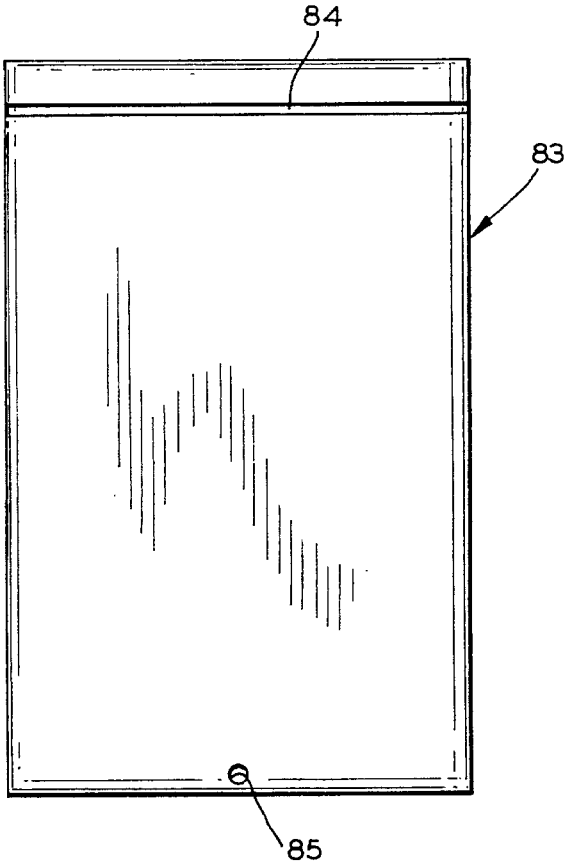
FIG. 9 is a side elevational view of a bag for lining the paint cup.
Figure 10:
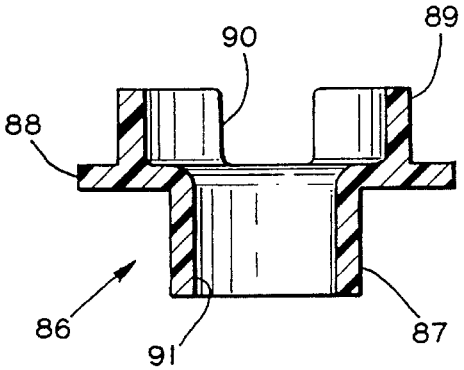
FIG. 10 is an enlarged cross sectional view through a bushing for securing the bag of FIG. 9 to the paint cup.

The paint cup 26 may be provided with graduations 82 (FIG. 5) for indicating the amount of paint in the cup 26 when the cup axis 60 is vertically oriented. After the spraying of a particular paint is completed, it is necessary to clean paint from the gun 25 and the paint cup 26. This is accomplished by flushing paint solvent through the cup 26 and the gun 25. To facilitate cleaning, the cup 26 may be lined with a disposable, flexible bag 83, as shown in FIGS. 9–11. The bag 83 is formed from a paint solvent resistant plastic and has an integral leak proof zipper closure 84. A small opening 85 is formed at the bottom of the bag 83. A bushing 86 is inserted into the opening 85 for securing the bag 83 to the opening 53 in the cup nipple 51. As shown in FIG. 10, the bushing 86 is generally tubular and has an end 87 larger than the bag opening 85. The bag opening 85 must be stretched to pass the bushing end 87. The tension around the bag opening 85 seals the bag 83 to the bushing 86. An enlarged diameter radial flange 88 on the bushing 86 prevents the entire bushing 86 from passing through the bag opening 85. The bushing 86 also has an end 89 which is of a larger diameter for grasping when securing the bag 83 to and removing the bag 83 from the paint cup 26. Preferably, a number of slits 90 are formed in the end 89 to facilitate paint flow from the bag to a central passage 91 through the bushing 86. The central passage 91 is stepped to have a larger diameter in the end 89 than in the end 87. Although a separate bushing 86 is illustrated, it will be appreciated that the bushing 86 may be molded as an integral part of the bag 83.

Figure 12:
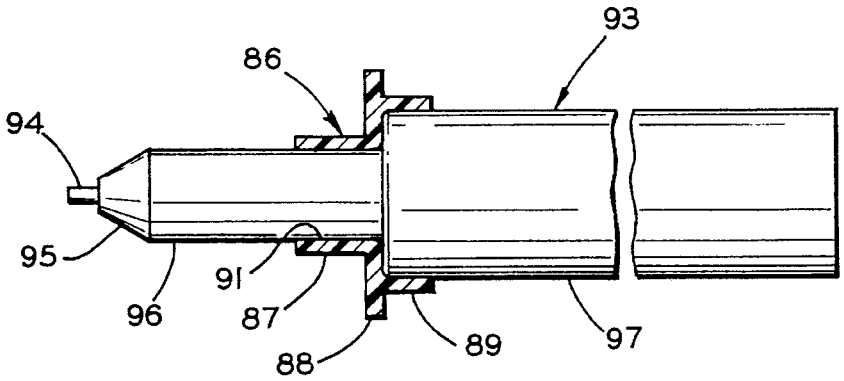
FIG. 12 is a side elevational view of a tool for piercing a hole in the bag of FIG. 9, inserting a bushing as sown in cross section in the pierced hole and securing the bushing to the paint cup.

The opening 85 may be formed in the bag 83 at the time of manufacture. However, a tool 93 as shown in FIG. 12 may be used to pierce the hole 85 in the bag 83, to install the bushing 86 in the bag 83 and to facilitate installing the bag 83 in the paint cup 26. The tool 93 has a sharp end 94 sized for piercing the small hole 85 in the bag 83. A conical section 95 is located adjacent the end 94. The conical section 95 connects the end 94 with a straight section 96 which has a diameter for passing through the passage 91 in the bushing 86. The straight section 96 is connected to an elongated larger diameter end 97 which forms a handle for the tool 93. The straight section 96 has a diameter which is received by the portion of the bushing passage 91 in the end 89, but is larger than the portion of the passage 91 in the bushing end 87. In use, a bushing 86 is positioned on the tool 93 as shown in FIG. 12. The tool end 94 is then used to pierce the hole 85 in the bag 83 from the inside of the bag. As the tool 93 is forced through the pierced hole 85, the bag stretches and passes over the conical section 95, over the straight section 96 and onto the bushing end 87.Because the bag is stretched over the bushing end 87, a seal is formed. While the tool 93 remains in the bushing 86, the bag 83 is placed in the paint cup 26, the tool end 94 is inserted into the nipple opening 53 and the tool handle 97 is pushed to seat the bushing 86 in the tapered opening 53. The tool 93 is then withdrawn from the bag 83 and the spray gun is ready for use.

FIG. 11 shows a bag 83 secured inside of the paint cup 26 by means of a bushing 86. The bushing end 87 is sized to be received by and seal to the nipple passage 51. In use, the gun operator secures a bag 83 inside of the cup 26 and opens the bag closure 84. A desired quantity of paint is poured into the bag 83, the closure 84 is sealed and the lid 35 is secured to the cup 26. Since the paint is retained in the bag, only the nipple passage 51, the paint tube 55 and the paint passages in the gun nozzle assembly 27 will be exposed to the paint and require cleaning after use. The operator then points the gun in an upward direction with the spray axis 37 vertical and triggers the gun. Suction created by the flow of atomization air through the gun 25 aspirates any trapped air from the bag 83. The bag 83 will collapse as air and paint are drawn from the bag 83. After all air is removed from the bag 83, the gun 25 will discharge paint, regardless of the direction in which the gun 25 is aimed. Thus, with suction feed and the use of a sealed collapsible bag 83, the gun can spray in an upward direction to paint the bottom of a horizontal surface. Prior art hand held spray guns could only spray when the gun was aimed in a direction which kept a paint feed tube submerged below the paint surface.

Figure 13:
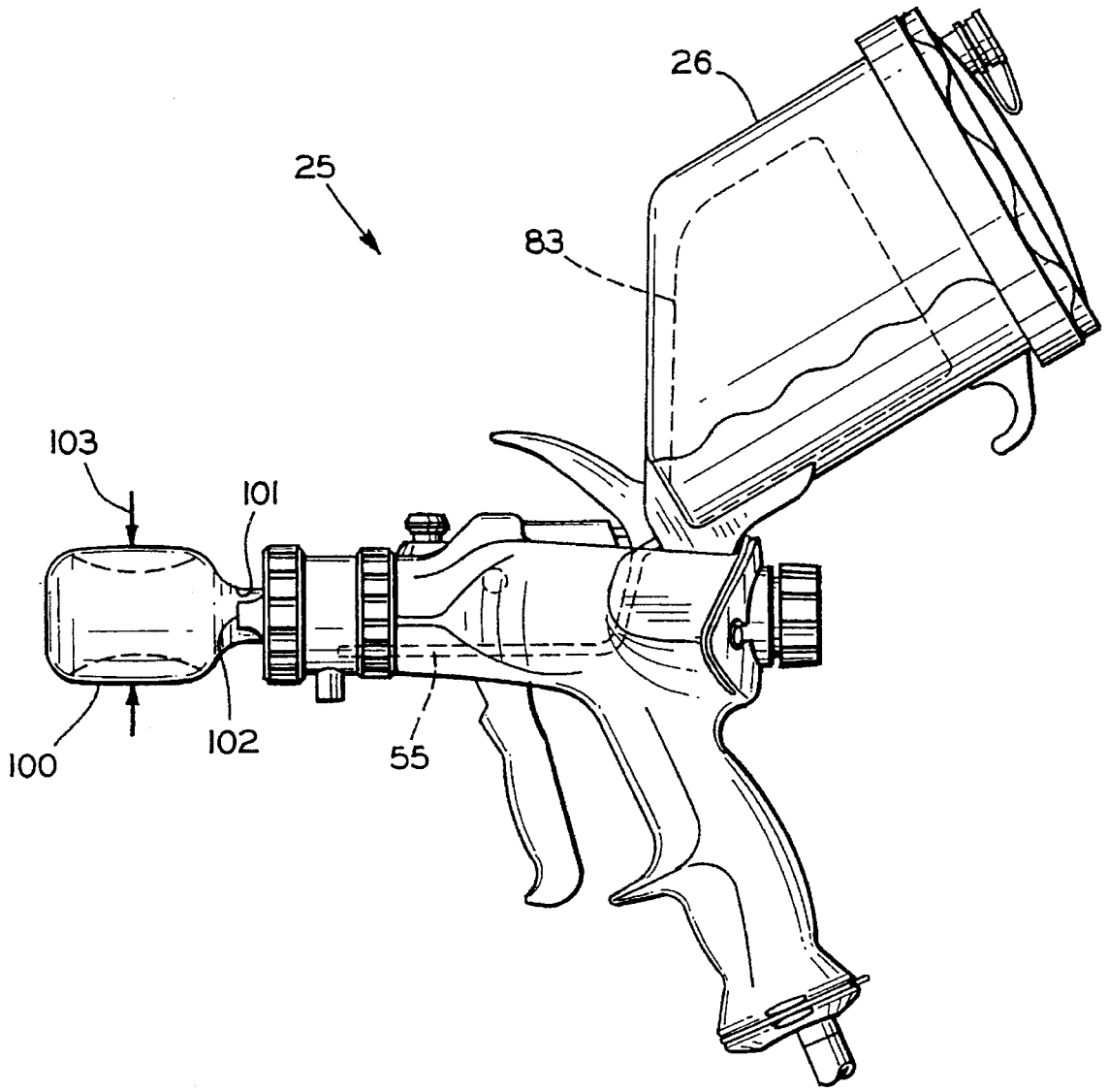
FIG. 13 is a side elevational view showing a plastic squeeze bottle placed against the air cap for cleaning the gun.

The spray gun 25 is easily cleaned with a minimum amount of solvent when the cup 26 is lined with a sealed bag 83. After spraying, any remaining paint may be left in the bag 83. Atomization air to the gun 25 is turned off to interrupt suction on the paint feed tube 55 when the gun 25 is triggered. Solvent is placed either in a syringe (not shown) or in a plastic squeeze bottle 100 FIG. 13). An outlet 101 from the syringe or squeeze bottle 100 is positioned against an air cap 102 and over a paint discharge orifice (not shown) on the nozzle assembly 27, the gun 25 is triggered, and the solvent is forced from the bottle 100 by squeezing the bottle 100 as illustrated by the arrows 103 and dashed lines. Solvent will then flow over the air cap surface and back through the nozzle assembly 27, the tube 55, the nipple opening 53 and into the bag 83. The solvent removes all paint from the spray gun and the dirty solvent is collected in the closed bag 83. The sealed bag containing the paint and used solvent is then removed from the gun for disposal. The flange 88 on the bushing 86 keeps the bushing 86 in the bag 83 when the bag 83 is pulled from the paint cup 26. Paint is flushed from the gun 25 with a minimum quantity of solvent. For example, a gun according to the invention has been cleaned with only 2 oz. (0.06 liter) of solvent, while a prior art gun typically requires 8 oz. (0.24 liter) or more of solvent for cleaning. Further, since the solvent is trapped in the bag 83 and not discharged into the atmosphere, it appears that the bag 83 will meet environmental regulations without the need for an expensive gun cleaner.

It will be appreciated that various modifications and changes may be made to the above described preferred embodiment of a hand held paint spray gun having a top mounted paint cup without departing from the spirit and the scope of the following claims.

We claim:

1. In a hand held paint spray gun including a body, a nozzle assembly mounted to a front end of said body and a handle extending from adjacent a rear end of said body, said gun having an atomization air supply hose connected to said handle, said nozzle assembly atomizing and discharging paint about a spray axis during operation, the improvement comprising a paint cup having first and second spaced ends, means securing said first paint cup end to said gun body adjacent said rear gun body end, said paint cup extending from said gun body opposite said gun handle past the rear end of said gun body along a central axis forming an angle of from 25° to 35° to said spray axis, and a tube connected for delivering paint from said cup to said nozzle assembly, wherein said paint cup has a lid secured to said second paint cup end extending substantially perpendicular to the paint cup axis, and a vent in said lid spaced on said lid from said paint cup axis in a direction away from said pray axis.

2. A hand held paint spray gun, as set forth in claim 1, and wherein said cup axis extends at an angle of substantially 30° to said spray axis.

3. In a hand held paint spray gun including a body, a nozzle assembly mounted to a front end of said body and a handle extending from adjacent a rear end of said body, said gun having an atomization air supply hose connected to said handle, said nozzle assembly atomizing and discharging paint about a spray axis during operation, the improvement comprising a paint cup, means securing said paint cup to said gun body adjacent said rear end, said paint cup extending from said gun body opposite said gun handle past the rear end of said gun body along an axis forming an angle of from 25° to 35° to said spray axis, and a tube connected for delivering paint from said cup to said nozzle assembly, and wherein said cup has an annular open end, a tapered annular exterior surface adjacent said open end and a tapered annular interior surface adjacent said open end, said tapered exterior and interior surfaces forming oppositely directed angles of from 5° to 15° to said cup axis, a lid having an annular groove for receiving said open cup end, said lid groove having two spaced tapered annular surfaces which are complementary to and engage with surface to surface contact said exterior and interior cup surfaces, said lid groove having a bottom which is spaced from said open cup end when said tapered cup surfaces engage said tapered groove surfaces, a retainer ring engaging a perimeter of said lid, means for releasably connecting said retainer ring to said cup to secure said lid over said open cup end, said lid separately sealing to both said exterior surface and said interior surface of said cup when said lid is secured to said cup, and a vent in said lid.

4. In a hand held paint spray gun including a body, a nozzle assembly mounted to a front end of said body and a handle extending from adjacent a rear end of said body, said gun having an atomization air supply hose connected to said handle, said nozzle assembly atomizing and discharging paint about a spray axis during operation, the improvement comprising a paint cup, means securing said paint cup to said gun body adjacent said rear end, said paint cup extending from opposite said gun handle past the rear end of said gun body along an axis forming an angle of from 25° to 35° to said spray axis, a tube connected for delivering paint from said cup to said nozzle assembly, said cup having an annular open end, a tapered annular exterior surface adjacent said open end and a tapered annular interior surface adjacent said open end, said tapered exterior and interior surfaces forming oppositely directed angles of from 5° to 15° to said cup axis, a lid having an annular groove for receiving said open cup end, a retainer ring engaging a perimeter of said lid, means for releasably connecting said retainer ring to said cup to secure said lid over said open cup end, said lid separately sealing to both said exterior surface and said interior surface of said cup when said lid is secured to said cup, and a vent in said lid comprises a tubular projection extending from said lid, said projection having an interior closed at one end by said lid and open at an opposite end, a removable cap closing said open projection end, a vent opening centered in said cap, and a pair of spaced vent openings in said cap between said projection interior and the interior of said paint cup, said spaced vent openings being located wherein any paint in said projection interior drains through one of said spaced openings into said cup when said gun is oriented with said spray axis horizontal and such paint drains through the other of said spaced openings into said cup when said gun is directed downwardly with said spray axis vertical.

5. A hand held paint spray gun, as set forth in claim 4 wherein said lid has a surface facing the interior of said cup when said lid is secured to said cup, and wherein said spaced openings are chamfered at said lid surface.

6. In a hand held paint spray gun including a body, a nozzle assembly mounted to a front end of said body and a handle extending from adjacent a rear end of said body, said gun having an atomization air supply hose connected to said handle, said nozzle assembly atomizing and discharging paint about a spray axis during operation, the improvement comprising a paint cup, means securing said paint cup to said gun body adjacent said rear end, said paint cup extending from opposite said gun handle past the rear end of said gun body along an axis forming an angle of from 25° to 35° to said spray axis, and a tube connected for delivering paint from said cup to said nozzle assembly and wherein said means securing said paint cup to said gun body adjacent said rear end comprises first and second spaced brackets, a first pin projecting from said first bracket towards said second bracket, a second pin projecting from said second bracket towards said first bracket, said pins engaging holes on said gun body, said first bracket having an end extending past said first pin, and means for securing said extended first bracket end to said gun body.

7. In a hand held paint spray gun including a body, a nozzle assembly mounted to a front end of said body and a handle extending from adjacent a rear end of said body, said gun having an atomization air supply hose connected to said handle, said nozzle assembly atomizing and discharging paint about a spray axis during operation, the improvement comprising a paint cup, means securing said paint cup to said gun body adjacent said rear end, said paint cup extending from said gun body opposite said gun handle past the rear end of said gun body along an axis forming an angle of from 25° to 35° to said spray axis, and a tube connected for delivering paint from said cup to said nozzle assembly, and wherein paint flows to said gun through suction feed, and further including a disposable flexible bag located in said paint cup, said bag having an opening adjacent one end and a sealed zipper closure adjacent an opposite end, means connecting said bag opening in fluid communications to deliver paint to said tube, said bag collapsing as paint is delivered from said bag to said gun.

8. In combination with a hand held paint spray gun, a paint cup mounted on said spray gun, tube means for delivering paint from said paint cup to said spray gun, a disposable flexible bag located in said paint cup, said bag having an opening adjacent one end and a sealed zipper closure adjacent an opposite end, means connecting said bag opening in fluid communications to deliver paint to said tube, said bag collapsing as paint is delivered from said bag to said gun.

9. A hand held paint spray gun, as set forth in claim 8, and wherein said tube is made of polytetrafluoroethylene.

10. A hand held paint spray gun, as set forth in claim 8, and wherein said connecting means comprises a bushing having an end passing through said bag opening, said bushing having an enlarged diameter flange located in said bag, said flange retaining said bushing in said bag opening.

11. In a hand held paint spray gun having a top mounted paint cup and a lid closing said paint cup, said lid having a vent opening including a vent passage through said lid communicating with a chamber closed by a cap having a central vent opening spaced from said vent passage, the improvement wherein said vent passage comprises a pair of spaced vent passages communicating between said paint cup and said chamber, and wherein one of said passages is located at the lowest position in said chamber when said spray gun is aimed with an axis about which paint is sprayed oriented horizontal and the other of said passages is located at the lowest position in said chamber when said spray gun is aimed downwardly to spray about a vertical axis.

12. A hand held paint spray gun, as set forth in claim 11, wherein said lid has a surface facing an interior of said cup when said lid is secured to said cup, and wherein said spaced openings are chamfered at said lid surface.

13. A method for operating it hand held paint spray gun of the type in which a flow of atomization air through said spray gun when said spray gun is triggered creates suction for feeding paint to said spray gun, said method comprising the steps of:

a) lining a paint cup mounted on said gun with a disposable flexible bag having a sealed zipper closure at one end and a paint outlet connected to deliver paint to said gun;

b) placing a volume of paint in said bag and sealing said zipper closure, said bag having a volume of air entrapped above the paint in said bag;

c) while positioning said spray gun with said paint outlet located above the paint in said bag, triggering said spray gun to create suction feed to draw the entrapped air from said bag; and d) using said spray gun to spray paint from said bag.

14. A method for operating a hand held suction feed paint spray gun, as set forth in claim 13, and, after spraying is completed, further including the steps of:

e) interrupting the flow of atomization air to said spray gun;

f) while triggering said spray gun, forcing solvent to flow from a nozzle on said spray gun back into said bag to flush paint from said spray gun; and g) disposing of said bag.

15. A method for securing a bag in a paint cup having an outlet opening, said bag having a zipper closure for sealing said, bag, said method comprising the steps of:

a) inserting a tool having a stepped cylindrical exterior surface into an opening through a bushing until said tool step abuts said bushing, said tool having a section extending through said bushing and tapering to a sharp end, and said bushing having a tubular end and an enlarged diameter flange adjacent said tubular end;

b) piercing an opening in a bottom region of said bag from the inside of said bag with said tool end;

c) forcing said tool end, said tapered section and said bushing end through the pierced bag opening until said bushing flange abuts said bag;

d) manipulating said tool to insert said bushing end into said paint cup outlet; and e) withdrawing said tool from said bushing and said bag.

16. A method for operating a paint spray gun having a paint atomizing nozzle assembly comprising the steps of:

a) delivering paint from a disposable bag to said spray gun nozzle assembly for spraying;

b) subsequent to completion of spraying, forcing a flow of paint cleaning solvent in a reverse direction from the nozzle assembly to the disposable bag for cleaning said spray gun and collecting the used solvent in the disposable bag; and c) disposing of the disposable bag and its contents.

17. A disposable liner for a paint cup secured to a spray gun, said paint cup having a bottom opening through which paint is withdrawn during spraying, said liner comprising a flexible paint receiving bag having first and second ends, a zipper closure sealing said bag first end, a paint discharge opening adjacent said bag second end, and means for securing said bag to the paint cup with said paint discharge opening connected to deliver paint to the cup bottom opening.

18. A disposable liner for a paint cup, as set forth in claim 17, and wherein said securing means comprises a bushing having a tubular end and an enlarged diameter flange adjacent said tubular end, said tubular end having an exterior diameter greater than the diameter of said paint discharge opening in said bag, and wherein said bushing is secured to said bag with said enlarged diameter flange located inside said bag and said tubular end extending through said paint discharge opening in said bag, whereby the resiliency of said bag retains said bushing in said paint discharge opening.

19. Apparatus for securing a flexible liner bag in a paint cup, such paint cup having an opening through which paint flows, comprising a bushing having a tubular end and an enlarged diameter flange, said tubular end having an exterior diameter sized for a friction fit in the paint cup opening, said bushing having an interior opening of a predetermined diameter extending through said tubular end and said flange, and a tool having a portion of a diameter greater than said predetermined diameter of said bushing opening, said tool having a first end and having a second end of a diameter for passing through said tubular bushing opening, whereby said second tool end is free to pass through said bushing opening until said greater diameter portion abuts said bushing.

20. The apparatus for securing a flexible liner bag in a paint cup, as set forth in claim 19, and wherein said tool second end has a length greater than the length of said bushing opening whereby said second end projects from said bushing opening when inserted through said bushing opening with said greater diameter portion abutting said bushing, and wherein the portion of said second end which projects from said bushing opening has means for piercing a hole in a flexible liner bag.

21. A disposable liner for a paint cup secured to a spray gun, said paint cup having a bottom opening through which paint is withdrawn during spraying, said liner comprising a flexible paint receiving bag having first and second ends, a fluid tight revealable closure sealing said bag first end, a paint discharge opening adjacent said bag second end, and means for securing said bag to the paint cup with said paint discharge opening connected to deliver paint to the cup bottom opening.

22. A disposable liner for a paint cup, as set forth in claim 21, and wherein said securing means comprises a bushing having a tubular end and an enlarged diameter flange adjacent said tubular end, said tubular end having an exterior diameter greater than the diameter of said paint discharge opening in said bag, and wherein said bushing is secured to said bag with said enlarged diameter flange located inside said bag and said tubular end extending through said paint discharge opening in said bag, whereby the resiliency of said bag retains said bushing in said paint discharge opening.

23. A disposable liner for a paint cup, as set forth in claim 21, and wherein said closure at said first bag end is a zipper closure.

* * * * *

UNITED STATES PATENT AND TRADEMARK OFFICE

CERTIFICATE OF CORRECTION

PATENT NO. : 5,582,350

DATED : December 10, 1996

INVENTOR(S) : Michael J. Kosmyna, Mark E. Charpie and Ralph A. Wisniewski

It is certified that error appears in the above-indentified patent and that said Letters Patent is hereby corrected as shown below:

Column 8, Claim 1, Line 61, after "said", change "pray" to -- spray --.

Column 9, Claim 5, Line 61, after "claim 4", insert -- , --.

Column 11, Claim 13, Line 3, after "operating", change "it" to -- a --.

Column 11, Claim 15, Line 33, after "said", omit -- , --.

Column 12, Claim 21, Line 43, after "tight", change "revealable" to -- resealable --.

Signed and Sealed this

First Day of April, 1997

Bruce Lehman

*Attest:*

BRUCE LEHMAN

*Attesting Officer*

*Commissioner of Patents and Trademarks*